US011092147B2

(12) United States Patent
Lin et al.

(10) Patent No.: US 11,092,147 B2
(45) Date of Patent: Aug. 17, 2021

(54) MAGNETICALLY DRIVEN PUMP

(71) Applicant: COOLER MASTER CO.,LTD., New Taipei (TW)

(72) Inventors: Wen-Hsien Lin, New Taipei (TW); Chiu Yu Yeh, New Taipei (TW)

(73) Assignee: COOLER MASTER CO., LTD., New Taipei (TW)

( * ) Notice: Subject to any disclaimer, the term of this patent is extended or adjusted under 35 U.S.C. 154(b) by 48 days.

(21) Appl. No.: 16/719,486

(22) Filed: Dec. 18, 2019

(65) Prior Publication Data

US 2021/0048011 A1 Feb. 18, 2021

(30) Foreign Application Priority Data

Aug. 12, 2019 (TW) ..... 108128638

(51) Int. Cl.

| | |
|---|---|
| ***F04B 39/14*** | (2006.01) |
| ***F04B 17/00*** | (2006.01) |
| ***F04B 39/12*** | (2006.01) |
| ***F04D 13/06*** | (2006.01) |

(52) U.S. Cl.

CPC ..... *F04B 39/14* (2013.01); *F04B 17/00* (2013.01); *F04B 39/121* (2013.01); *F04D 13/0606* (2013.01); *F04D 13/0626* (2013.01)

(58) Field of Classification Search

CPC .. F04D 13/026; F04D 13/0633; F04D 13/064; F04D 29/628; F04D 13/027; F04D 13/0626; F04D 29/426; F04D 13/025; F04D 25/06; F04D 29/043; F04D 29/0473

See application file for complete search history.

(56) References Cited

U.S. PATENT DOCUMENTS 4,082,380 A * 4/1978 Klaus ..... F16C 17/04 384/425
4,487,557 A * 12/1984 Ruyak ..... H02K 49/106 310/104
4,722,661 A * 2/1988 Mizuno ..... F04D 13/026 310/106

(Continued)

FOREIGN PATENT DOCUMENTS

CN 202883459 U * 4/2013

OTHER PUBLICATIONS

English Translation CN 201220466480 (Year: 2013).*

*Primary Examiner* — Dominick L Plakkoottam
(74) *Attorney, Agent, or Firm* — Maschoff Brennan

(57) ABSTRACT

The disclosure provides a magnetically driven pump which including a base, a spacer sleeve, a cover, a stator assembly and a rotor assembly. The base has a first accommodation space. The spacer sleeve is mounted to the base and partially located in the first accommodation space. The spacer sleeve has a second accommodation space not connected to the first accommodation space. The cover has through holes. The cover is mounted to the base, and the through holes are connected to the second accommodation space. The stator assembly is sleeved on the spacer sleeve and located in the first accommodation space. The rotor assembly includes a shaft, an impeller and a magnet assembly. Two ends of the shaft are rotatably disposed on the cover and the spacer sleeve, the shaft is partially located in the second accommodation space, and the impeller and the magnet assembly are fixed on the shaft.

10 Claims, 5 Drawing Sheets

(56) References Cited

U.S. PATENT DOCUMENTS

| | | | | |
|---|---|---|---|---|
| 4,871,301 | A * | 10/1989 | Buse | F04D 13/026 417/420 |
| 5,397,220 | A * | 3/1995 | Akihisa | F04D 29/047 417/369 |
| 5,863,179 | A * | 1/1999 | Westphal | F04D 13/027 415/206 |
| 7,057,320 | B2 * | 6/2006 | Abordi | H02K 1/278 310/103 |
| 8,651,835 | B2 * | 2/2014 | Kim | F04D 13/027 417/420 |
| 2004/0062664 | A1 * | 4/2004 | Weigold | F04D 29/5813 417/357 |
| 2006/0057002 | A1 * | 3/2006 | Nakanishi | F04D 13/0686 417/423.7 |
| 2006/0245955 | A1 * | 11/2006 | Horiuchi | F04D 29/0465 417/420 |
| 2011/0116921 | A1 * | 5/2011 | Lee | F04D 29/0473 415/229 |
| 2011/0116953 | A1 * | 5/2011 | Yi | F04D 29/628 417/423.7 |
| 2011/0171048 | A1 * | 7/2011 | Snider | F04D 13/064 417/353 |
| 2013/0225910 | A1 * | 8/2013 | Woodard | F04D 29/047 600/16 |
| 2014/0271283 | A1 * | 9/2014 | Yi | F04D 25/06 417/420 |
| 2015/0010392 | A1 * | 1/2015 | Lazich | F04D 29/628 415/170.1 |
| 2019/0309754 | A1 * | 10/2019 | Lee | F04D 29/242 |
| 2019/0316594 | A1 * | 10/2019 | Hattori | F04D 29/043 |
| 2020/0191161 | A1 * | 6/2020 | Svarre | F04D 29/043 |
| 2020/0191166 | A1 * | 6/2020 | Svarre | F04D 29/5813 |

* cited by examiner

MAGNETICALLY DRIVEN PUMP

CROSS-REFERENCE TO RELATED APPLICATIONS

This non-provisional application claims priority under 35 U.S.C. § 119(a) on Patent Application No(s). 108128638 filed in Taiwan, R.O.C on Aug. 1, 2019, the entire contents of which are hereby incorporated by reference.

TECHNICAL FIELD

The disclosure relates to a pump, more particularly to a magnetically driven pump.

BACKGROUND

An air-conditioning system can provide cooling and humidity control for all or part of a building, a semiconductor factory or a cloud server room. Especially for the cloud server room, the air-conditioning system has to be able to timely and effectively remove massive heat generated by a larger amount of servers to maintain the operation and performance. In recent years, liquid cooling system is widely applied to solve the above problem. The conventional liquid cooling system is consisted of an evaporator, a water spacer sleeve, and a pump and other required elements, such as tubing, and the conventional liquid cooling system is able to circulate working fluid to continuously absorb and dissipate waste heat.

However, in the pump of the conventional liquid cooling system, the shaft is fixed to the outer casing and is stationary, and the bushing and the bearings are required to be sleeved on the shaft to allow the magnet assembly of the pump to rotated with respect to the shaft. In addition, the magnet assembly does not have a single ringed-shaped magnet but has a plurality of magnets being separated from each other, thus the installation of the magnets of the conventional pump is time-consuming and increase the overall cost.

SUMMARY OF THE INVENTION

The disclosure provides a magnetically driven pump capable of being assembled in an efficient and cost-effective manner.

One embodiment of the disclosure provides a magnetically driven pump. The magnetically driven pump includes a base, a spacer sleeve, a cover, a stator assembly and a rotor assembly. The base has a first accommodation space. The spacer sleeve is mounted to the base and partially located in the first accommodation space. The spacer sleeve has a second accommodation space, and the second accommodation space is not connected to the first accommodation space. The cover has a first through hole and a second through hole. The cover is mounted to the base, and the first through hole and the second through hole are connected to the second accommodation space. The stator assembly is sleeved on the spacer sleeve and located in the first accommodation space. The rotor assembly includes a shaft, an impeller and a magnet assembly. Two opposite ends of the shaft are rotatably disposed on the cover and the spacer sleeve, the shaft is partially located in the second accommodation space, and the impeller and the magnet assembly are fixed on the shaft.

According to the magnetically driven pump as discussed above, the shaft is rotatably disposed on the cover and the base, such that the magnetically driven pump does not require any bushing between the magnet assembly and the shaft, in addition, the impeller and the magnet assembly can be installed onto the shaft in advance, furthermore, the magnetic ring of the magnet assembly is a single magnet in ring shape, such that the installation of the magnetic ring can be implemented in one step, thus the magnetically driven pump can be assembled in a much more efficient and cost-effective manner.

BRIEF DESCRIPTION OF THE DRAWINGS

The present disclosure will become better understood from the detailed description given herein below and the accompanying drawings which are given by way of illustration only and thus are not intending to limit the present disclosure and wherein.

DETAILED DESCRIPTION

Figure 1:
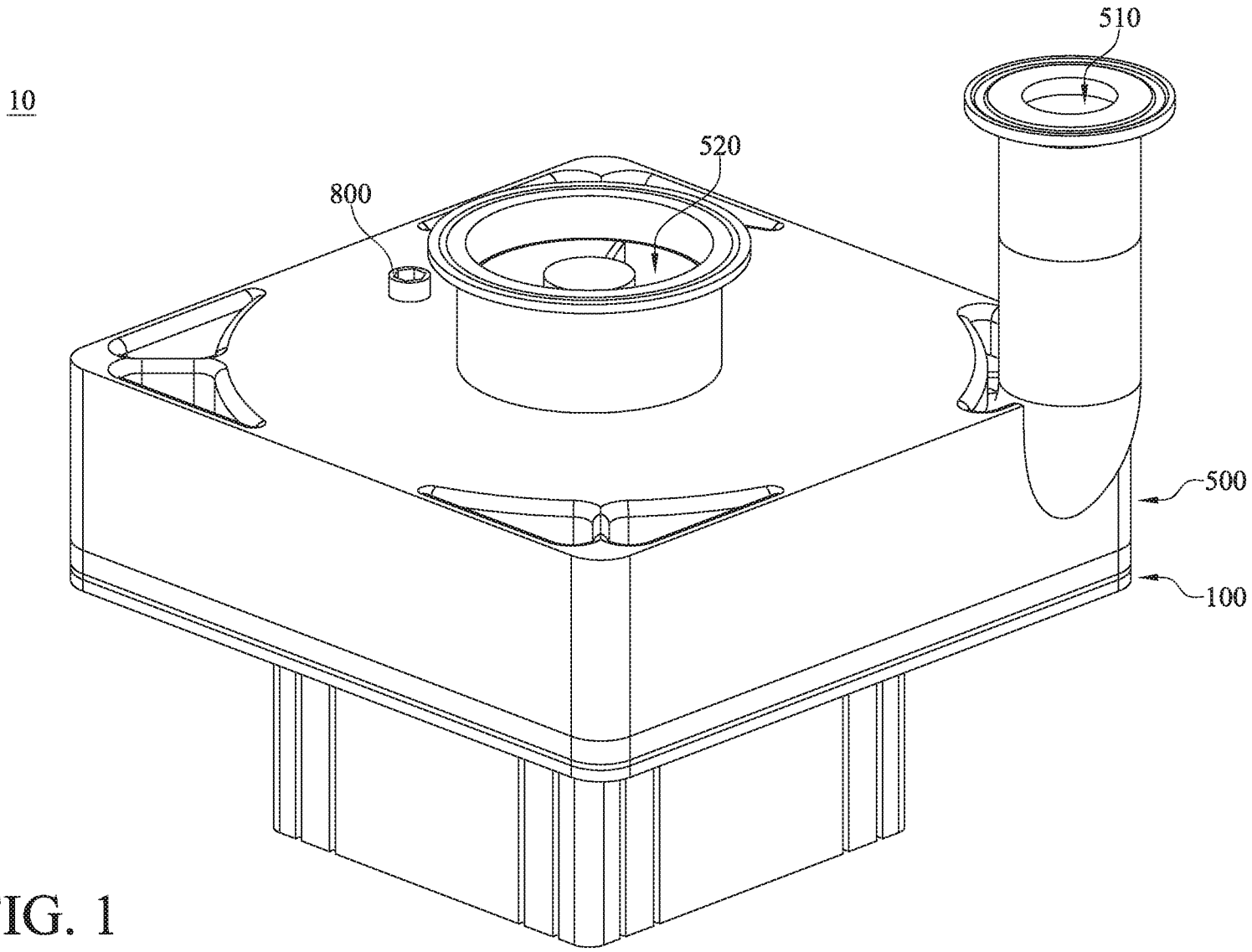
FIG. 1 is a perspective view of a magnetically driven pump according to one embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In addition, the terms used in the present disclosure, such as technical and scientific terms, have its own meanings and can be comprehended by those skilled in the art, unless the terms are additionally defined in the present disclosure. That is, the terms used in the following paragraphs should be read on the meaning commonly used in the related fields and will not be overly explained, unless the terms have a specific meaning in the present disclosure.

Figure 2:
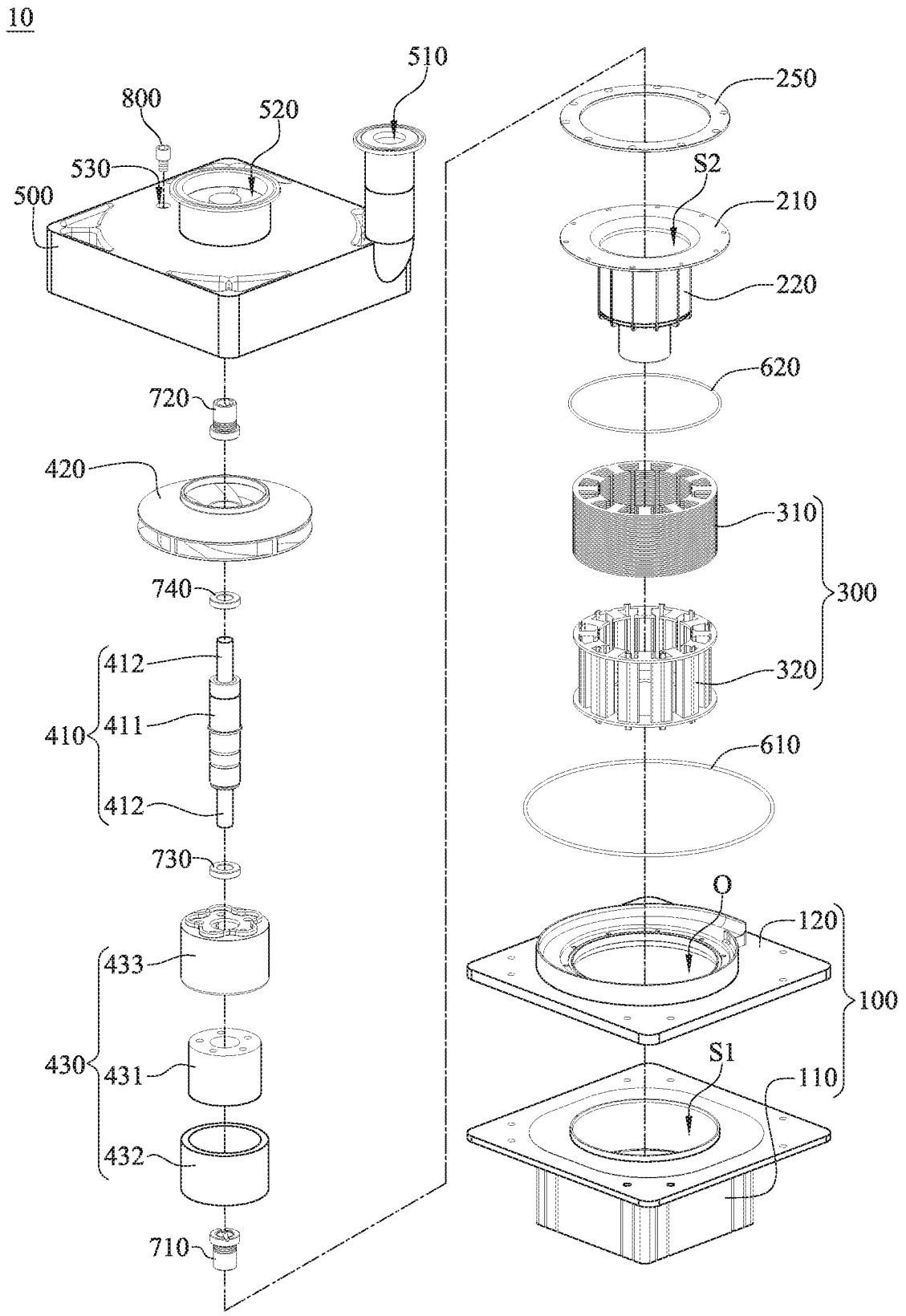
FIG. 2 is an exploded view of the magnetically driven pump in FIG. 1.
Figure 3:
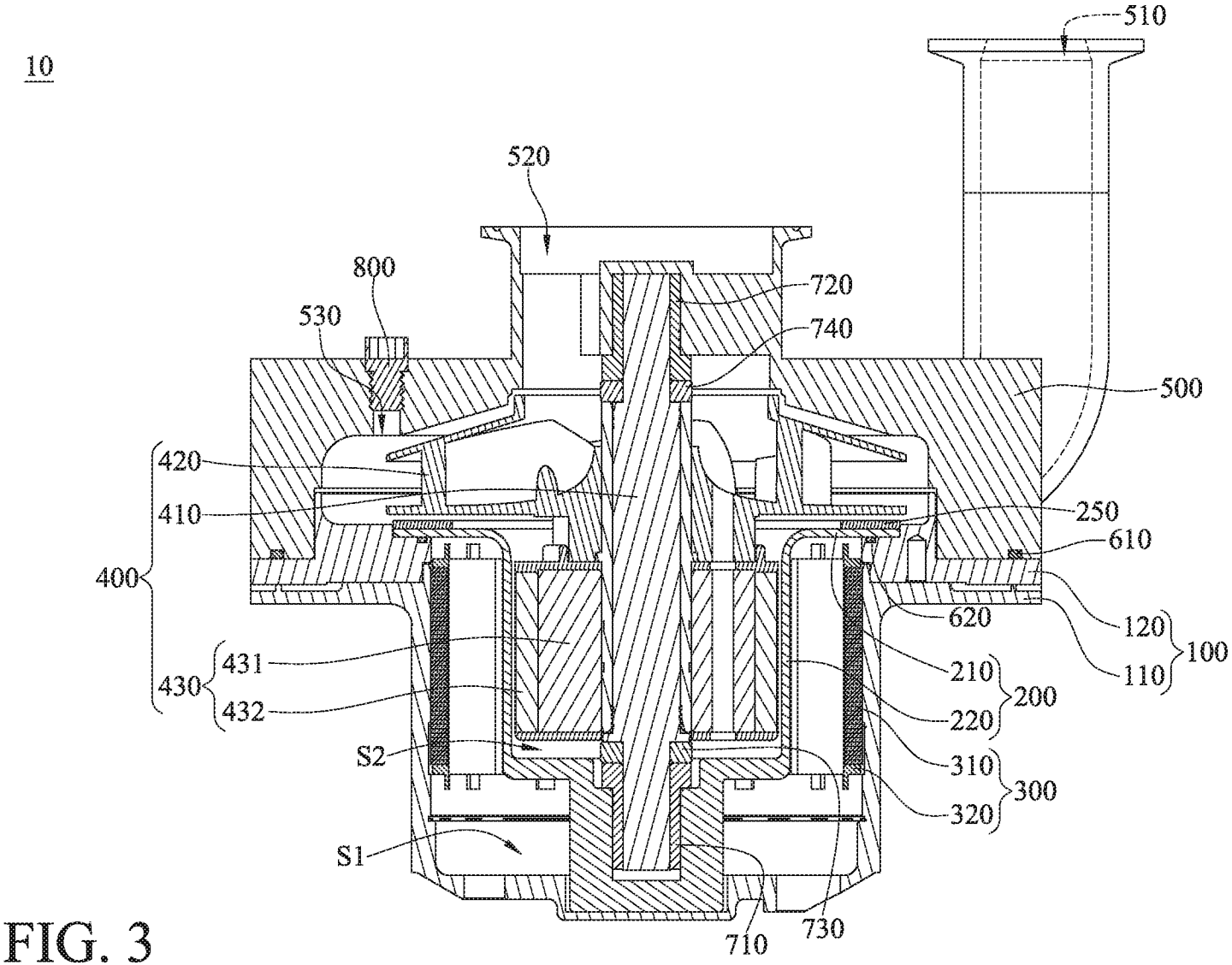
FIG. 3 is a cross-sectional view of the magnetically driven pump in FIG. 1.

Referring to FIGS. 1 to 3, FIG. 1 is a perspective view of a magnetically driven pump 10 according to one embodiment of the disclosure, FIG. 2 is an exploded view of the magnetically driven pump 10 in FIG. 1, and FIG. 3 is a cross-sectional view of the magnetically driven pump 10 in FIG. 1.

In this embodiment, the magnetically driven pump 10 includes a base 100, a spacer sleeve 200, a stator assembly 300, a rotor assembly 400 and a cover 500. In addition, the magnetically driven pump 10 further includes, for example, a first sealing ring 610 and a second sealing ring 620. Furthermore, the magnetically driven pump 10 further includes, for example, two bearings 710 and 720 and two wear rings 730 and 740.

The base 100 includes a stand part 110 and a support part 120. The stand part 110 has a first accommodation space S1. The support part 120 has an opening O. The support part 120 is stacked on the stand part 110, and the opening O is connected to the first accommodation space S1.

The spacer sleeve 200 includes a flange part 210 and a barrel part 220. The flange part 210 radially protrudes from the barrel part 220, and the barrel part 220 has a second accommodation space S2 for accommodating working fluid.

The flange part 210 is stacked on the support part 120, and the barrel part 220 is partially located in the first accommodation space S1 of the stand part 110. The second accommodation space S2 is not connected to the first accommodation space S1; that is, the working fluid in the second accommodation space S2 is not allowed to flow to the first accommodation space S1.

The cover 500 is also stacked on the support part 120 and has a first through hole 510 and a second through hole 520. The first through hole 510 and the second through hole 520 are both connected to the second accommodation space S2 of the barrel part 220, such that the working fluid is allowed to flow into the second accommodation space S2 from the second through hole 520 and is allowed to flow out of the second accommodation space S2 through the first through hole 510. In such a case, the first through hole 510 can be considered as a fluid outlet, and the second through hole 520 can be considered as a fluid inlet.

In this embodiment, the magnetically driven pump 10 further includes a plug 800 removably plugged into an exhaust hole 530 of the cover 500. The plug 800 is, for example, a bolt. When bubbles in the magnetically driven pump 10 are accumulated to a certain amount, the removal of the plug 800 can let the bubbles to be exhausted out of the magnetically driven pump 10 through the exhaust hole 530. By doing so, the vibration of the magnetically driven pump 10 caused by the excess amount of bubbles contained in the working fluid can be significantly reduced.

In this embodiment, the first sealing ring 610 is located between and clamped by the cover 500 and the support part 120 of the base 100 so as to close a gap between the cover 500 and the support part 120. The second sealing ring 620 is located between and clamped by the flange part 210 of the spacer sleeve 200 and the support part 120 of the base 100 so as to close a gap between the flange part 210 of the spacer sleeve 200 and the support part 120.

In this embodiment, the magnetically driven pump 10 further includes a gasket 250. The gasket 250 is stacked on a side the flange part 210 of the spacer sleeve 200 away from the support part 120 of the base 100. The gasket 250 is fixed in position on the flange part 210 via, for example, screws (not shown). The gasket 250 secures the airtightness between the flange part 210 and the support part 120.

The stator assembly 300 includes a magnetic steel core 310 and a stator holder 320. The magnetic steel core 310 includes a set of laminated silicon steel sheets being riveted to each other. The stator holder 320 is made of, for example, plastic, and at least part of the magnetic steel core 310 is wrapped by the stator holder 320 by an over-molding process. The stator holder 320 is sleeved on the barrel part 220 of the spacer sleeve 200 and located in the first accommodation space S1 that does not contain the working fluid.

The rotor assembly 400 is partially located in the second accommodation space S2 and includes a shaft 410, an impeller 420 and a magnet assembly 430. The shaft 410 includes a thicker part 411 and two thinner parts 412. The thicker part 411 is located between and connected to the two thinner parts 412, and the thicker part 411 has a larger outer diameter than that of each of the thinner parts 412. The two bearings 710 and 720 are respectively mounted on the two thinner parts 412, and the thinner parts 412 are respectively mounted on the cover 500 and the barrel part 220 of the spacer sleeve 200 via the bearings 710 and 720, such that the shaft 410 is allowed to be positioned in place and rotatable with respect to the cover 500 and the spacer sleeve 200; that is, the shaft 410 is rotatably disposed on the cover 500 and the spacer sleeve 200.

The two wear rings 730 and 740 are respectively mounted on the thinner parts 412 and respectively located between the bearings 710 and 720 and the thicker part 411. In specific, the wear ring 730 is located between the bearing 710 and the thicker part 411, and the wear ring 740 is located between the bearing 720 and the thicker part 411. The wear rings 730 and 740 can increase the liftspan of the magnetically driven pump 10.

The impeller 420 and the magnet assembly 430 are fixed to the shaft 410, such that the impeller 420 and the magnet assembly 430 can be rotated by being driven by the shaft 410. The impeller 420 is configured to drive the working fluid in the magnetically driven pump 10 to flow from the second through hole 520 to the first through hole 510. The magnet assembly 430 includes an inner core 431, a magnetic ring 432 and a wrap component 433. The inner core is, for example, made of iron, and the magnetic ring 432 is disposed on and surrounds the inner core 431. The wrap component 433 is made of, for example, plastic, and the magnetic ring 432 and the inner core 431 are wrapped by the wrap component 433 by the over-molding process, such that the inner core 431, the magnetic ring 432 and the wrap component 433 are assembled to each other. In such a configuration, the magnet assembly 430 can be mounted on the shaft 410 in one step. In this embodiment, the wrap component 433 is fixed on the shaft 410 in tight contact manner.

In the conventional magnetically driven pump, the shaft is fixed to the outer casing and is stationary, and the bushing and the bearings are required to be sleeved on the shaft to allow the magnet assembly to be rotated with respect to the shaft. Moreover, the conventional magnetically driven pump does not have a single ring-shaped magnet but has a plurality of magnets being separated from one another, thus the installation of the magnets to the conventional magnetically driven pump is time-consuming and increase the overall cost. In contrast, in the embodiment of the disclosure, the shaft 410 is rotatable with the help of the bearings 710 and 720, such that the magnetically driven pump 10 does not require any bushing between the shaft 410 and the magnet assembly 430, in addition, and the impeller 420 and the magnet assembly 430 can be installed onto the shaft 410 in advance, furthermore, the magnetic ring 432 of the magnet assembly 430 is a single magnet in ring shape, such that the installation of the magnetic ring 432 can be implemented in one step, thus the magnetically driven pump 10 can be assembled in a much more efficient and cost-effective manner comparing to the conventional magnetically driven pump.

In this embodiment, a central line of the first through hole 510 is parallel to an axis of the shaft 410, that is, the first through hole 510 extends along a direction parallel to the axis of the shaft 410, but the present disclosure is not limited thereto; in some other embodiments, the central line of the first through hole may be perpendicular to the axis of the shaft.

Figure 4:
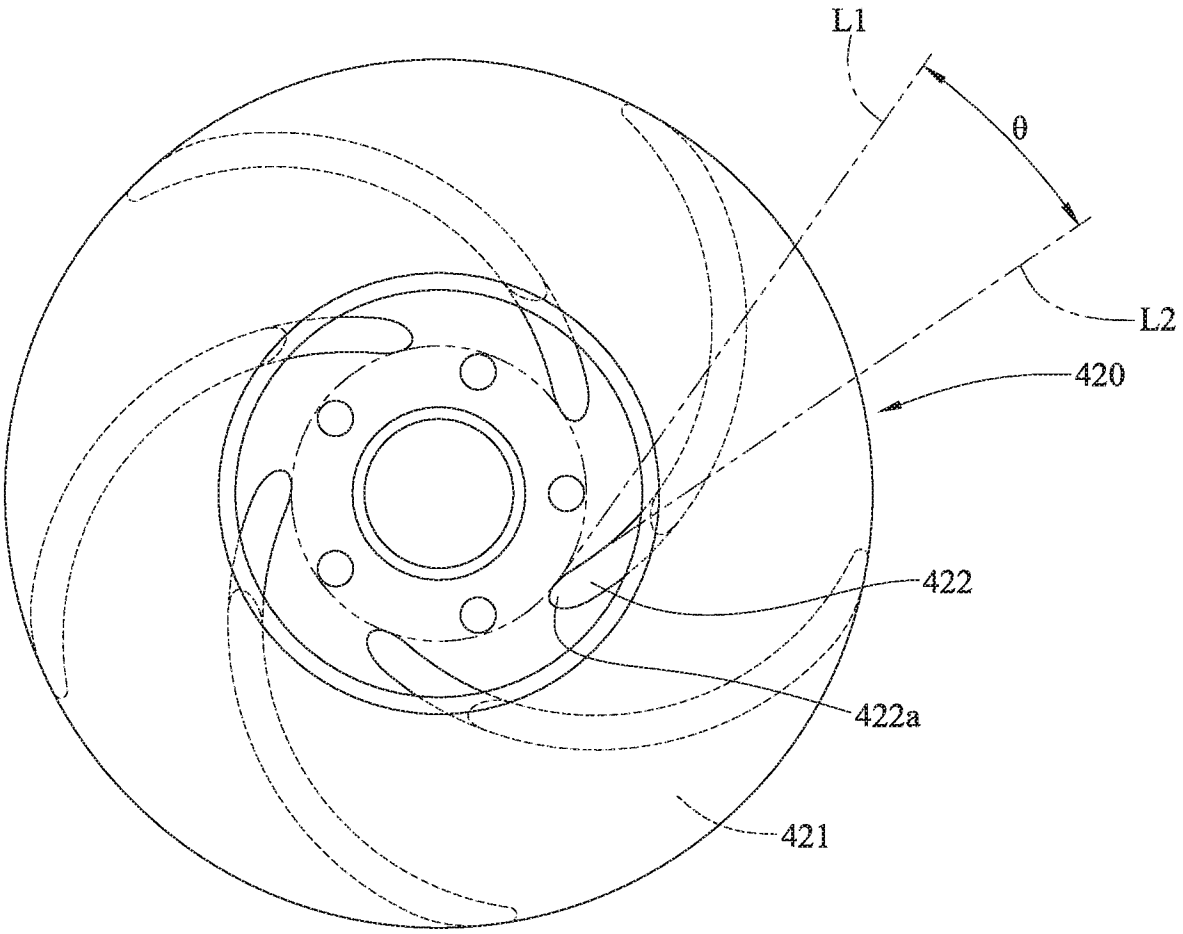
FIG. 4 is a plan view of an impeller of the magnetically driven pump in FIG. 2.
Figure 5:
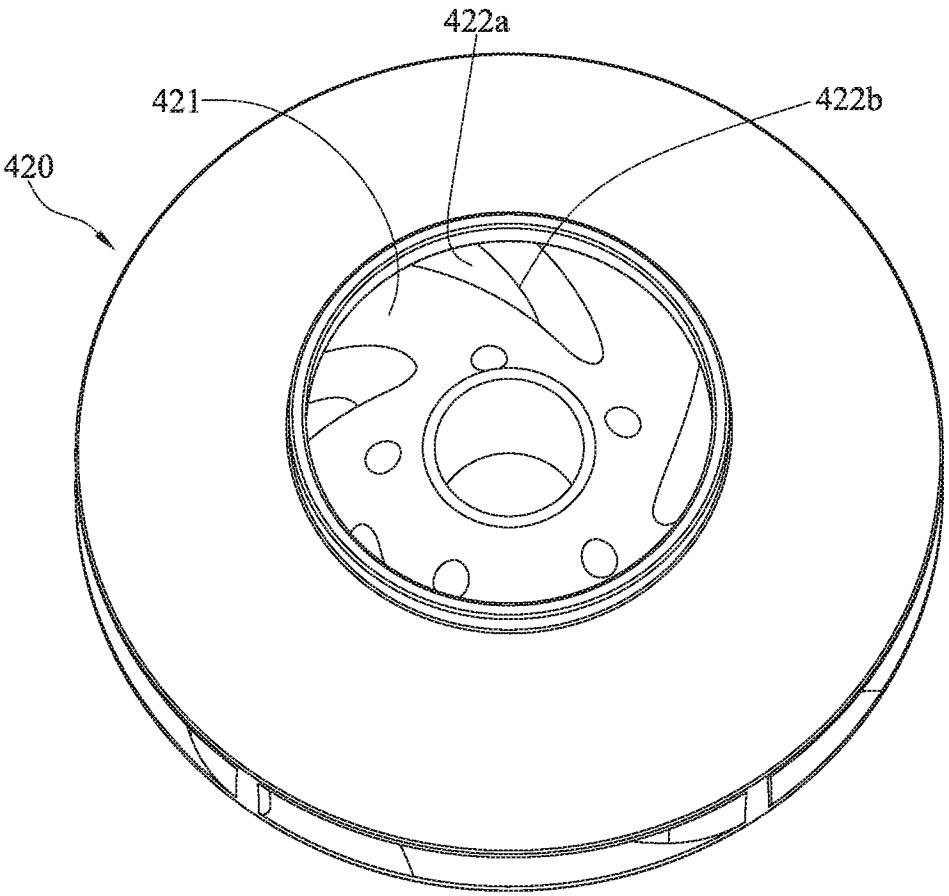
FIG. 5 is a perspective view of the impeller of the magnetically driven pump in FIG. 2.

Referring to FIGS. 4 and 5, FIG. 4 is a schematic view of an impeller of the magnetically driven pump in FIG. 2, and FIG. 5 is a perspective view of the impeller of the magnetically driven pump in FIG. 2.

In this embodiment, the impeller 420 has a plate part 421 and a plurality of vanes 422. The vanes 422 protrude from the plate part 421. Each of the vanes 422 has an inlet end 422*a* close to the shaft 410. Each inlet end 422*a* has an inlet angle θ, and the inlet angle θ is, for example, approximately 17.4 degrees. The inlet angle θ is formed between two lines L1 and L2. The line L1 is a tangent line of an inner circle formed within the inlet ends 422*a* of the vanes 422 and is located between the inner circle and one of the inlet ends 422*a*, and the line L2 is a tangent line of the inlet end 422*a*. As shown in FIG. 5, each inlet end 422*a* has a curved edge 422*b* extending from the plate part 421 toward a direction away from the plate part 421; that is, the curved edge 422*b* is directly connected to the plate part 421, and the curved edge 422*b* extends from a position where it is connected to the plate part 421 toward the direction away from the plate part 421 in a smooth inclination, thereby reducing the effect of cavitation.

According to the magnetically driven pump as discussed above, the shaft is rotatably disposed on the cover and the base by being mounted on the bearings, such that the magnetically driven pump does not require any bushing between the magnet assembly and the shaft, in addition, the impeller and the magnet assembly can be installed onto the shaft in advance, furthermore, the magnetic ring of the magnet assembly is a single magnet in ring shape, such that the installation of the magnetic ring can be implemented in one step, thus the magnetically driven pump can be assembled in a much more efficient and cost-effective manner comparing to the conventional magnetically driven pump.

It will be apparent to those skilled in the art that various modifications and variations can be made to the present disclosure. It is intended that the specification and examples be considered as exemplary embodiments only, with a scope of the disclosure being indicated by the following claims and their equivalents.

What is claimed is:

1. A magnetically driven pump, comprising:

a base, having a first accommodation space;

a spacer sleeve, mounted to the base and partially located in the first accommodation space, wherein the spacer sleeve has a second accommodation space, and the second accommodation space is not connected to the first accommodation space;

a cover, having a first through hole and a second through hole, wherein the cover is mounted to the base, and the first through hole and the second through hole are connected to the second accommodation space;

a stator assembly, sleeved on the spacer sleeve and located in the first accommodation space; and a rotor assembly, comprising a shaft, an impeller and a magnet assembly, wherein two opposite ends of the shaft are rotatably disposed on the cover and the spacer sleeve, the shaft is partially located in the second accommodation space, and the impeller and the magnet assembly are fixed on the shaft;

wherein the base comprises a stand part and a support part, the stand part has the first accommodation space, the support part has an opening, the support part is stacked on the stand part, the opening is connected to the first accommodation space, and the spacer sleeve and the cover are stacked on the support part;

wherein the spacer sleeve comprises a flange part and a barrel part, the flange part radially protrudes from the barrel part, the barrel part has the second accommodation space, the flange part is stacked on the support part of the base, and the barrel part is partially located in the first accommodation space;

wherein the magnetically driven pump further comprises a gasket stacked on a side of the flange part away from the base.

2. The magnetically driven pump according to claim 1, further comprising two bearings, wherein the shaft comprises a thicker part and two thinner parts, the thicker part is located between and connected to the two thinner parts, the two bearings are respectively mounted on the two thinner parts, and the two thinner parts are respectively disposed on the cover and the spacer sleeve via the two bearings, such that the shaft is allowed to be rotatable with respect to the cover and the spacer sleeve.

3. The magnetically driven pump according to claim 2, further comprising two wear rings, wherein the two wear rings are respectively mounted on the two thinner parts of the shaft and located between the two bearings and the thicker part of the shaft.

4. The magnetically driven pump according to claim 1, wherein the magnet assembly comprises an inner core, a magnetic ring and a wrap component, the magnetic ring surrounds the inner core, the magnetic ring and the inner core are wrapped in the wrap component, and the wrap component is fixed on the shaft.

5. The magnetically driven pump according to claim 1, wherein the stator assembly comprises a magnetic steel core and a stator holder, at least part of the magnetic steel core is wrapped by the stator holder, and the stator holder is sleeved on the spacer sleeve.

6. The magnetically driven pump according to claim 1, wherein the impeller has a plate part and a plurality of vanes, the plurality of vanes protrudes from the plate part, each of the plurality of vanes has an inlet end which is close to the shaft, and each of the inlet ends has an inlet angle being 17.4 degrees.

7. The magnetically driven pump according to claim 6, wherein each of the inlet ends further has a curved edge extending from the plate part toward a direction away from the plate part.

8. The magnetically driven pump according to claim 1, further comprising a first sealing ring located between and clamped by the cover and the support part of the base.

9. The magnetically driven pump according to claim 8, further comprising a second sealing ring located between and clamped by the flange part of the spacer sleeve and the support part of the base.

10. The magnetically driven pump according to claim 1, further comprising a plug, wherein the cover further has an exhaust hole, the plug is removably plugged into the exhaust hole.

* * * * *